US005569043A

United States Patent [19]

Liu

[11] Patent Number: 5,569,043

[45] Date of Patent: Oct. 29, 1996

[54] LATCH MECHANISM FOR USE IN AN ELECTRIC CONNECTOR

[76] Inventor: Kai-Mai Liu, No. 20, Lane 426, Sec 2, Chong Der Rd., Taichung, Taiwan

[21] Appl. No.: 511,254

[22] Filed: Aug. 4, 1995

[51] Int. Cl.[6] ..... H01R 13/62

[52] U.S. Cl. ..... 439/326

[58] Field of Search ..... 439/326, 327, 439/328

[56] References Cited

U.S. PATENT DOCUMENTS

| | | | |
|---|---|---|---|
| 5,112,242 | 5/1992 | Choy et al. | 439/326 |
| 5,174,780 | 12/1992 | Yang Lee | 439/326 |
| 5,286,217 | 2/1994 | Liu et al. | 439/326 |

*Primary Examiner*—Neil Abrams
*Assistant Examiner*—Yong Kim
*Attorney, Agent, or Firm*—Charles E. Baxley, Esq.

[57] ABSTRACT

An electric connector includes a housing having a groove for engaging with a daughter card and having a casing and a beam extended from the end. A pair of latch members each includes a pair of resilient and spaced legs for being force-fitted in the casings. The latch members each includes a projection having a tapered surface for allowing the daughter card to be moved over the projection and each includes another projection having a stop for engaging with the beam so as to prevent the latch members from being deformed. The latch members may apply a force against the daughter card so as to resiliently and stably retain the daughter card in place.

2 Claims, 5 Drawing Sheets

LATCH MECHANISM FOR USE IN AN ELECTRIC CONNECTOR

BACKGROUND OF THE INVENTION

1. Field of the Invention

The present invention relates to a latch mechanism, and more particularly to a latch mechanism for use in an electric connector.

2. Description of the Prior Art

Typical computers comprise a number of daughter cards that are required to be secured to a mother card. A latch mechanism or a latch means is required to be provided in the mother card so as to secure the daughter card in place and so as to electrically connect the daughter card to the mother card. Two typical latch mechanisms are disclosed in U.S. Pat. No. 5,286,217 to Liu et al., filed on Aug. 15, 1991; and U.S. Pat. No. 5,383,792 to Korsunsky et al., filed on May 4, 1993. Both of the prior arts comprise a latch mechanism including a pair of latch members for securing the daughter cards in place. However, the typical latch members comprise a configuration that will be easily broken such that the daughter cards may not be stably held in place. It is very important that the daughter cards be stably secured to the mother card so as to maintain excellent electric connections between the mother card and the daughter cards. The electric connections between the mother card and the daughter card will be affected if the daughter cards are not stably secured in place.

The present invention has arisen to mitigate and/or obviate the afore-described disadvantages of the conventional latch mechanisms for electric connectors.

SUMMARY OF THE INVENTION

The primary objective of the present invention is to provide a latch mechanism for use in an electric connector in which the latch mechanism may stably secure the daughter card in place.

In accordance with one aspect of the invention, there is provided an electric connector for engaging with and for securing a daughter card, the daughter card has two orifices formed therein. The electric connector comprises a housing including a middle portion having a groove longitudinally formed therein for engaging with the daughter card and including two ends each having a casing formed thereon and each having a beam extended upward therefrom, the beam each including an engaging protrusion means extended therefrom for engaging with the orifices of the daughter card, the casings each including a hollow interior and each including a notch formed therein distal to the beam, and a pair of latch members each including a lower portion having a pair of spaced legs formed therein for engaging with the casings and for being force-fitted in the casings, the legs including a catch means extended therefrom for engaging with the notch so as to secure the latch members to the casing, the latch members each including a tapered middle portion for increasing a resilience of the latch members, the tapered middle portion of the latch members each including an upper portion having a pair of projections extended therefrom for engaging with the daughter card therebetween, a first of the projections including a tapered surface formed therein for engaging with the daughter card and for allowing the daughter card to be moved over the first projection and to be engaged between the projections, the latch members each including a knob provided on top thereof for operating the latch members and for disengaging the engaging protrusion means from the orifices of the daughter card. The latch members are arranged for applying a force against the daughter card so as to resiliently and stably retain the daughter card in place.

The projections include a second projection having a stop extended therefrom for engaging with the beam so as to stably retain the latch members to the beams and so as to prevent the latch members from being deformed.

The legs include a bottom portion having a bulge extended toward the beam for engaging with the casing so as to engage the legs in the casing with the force-fitted engagement.

The legs include a tapered configuration for engaging with the casing so as to be force-fitted in the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
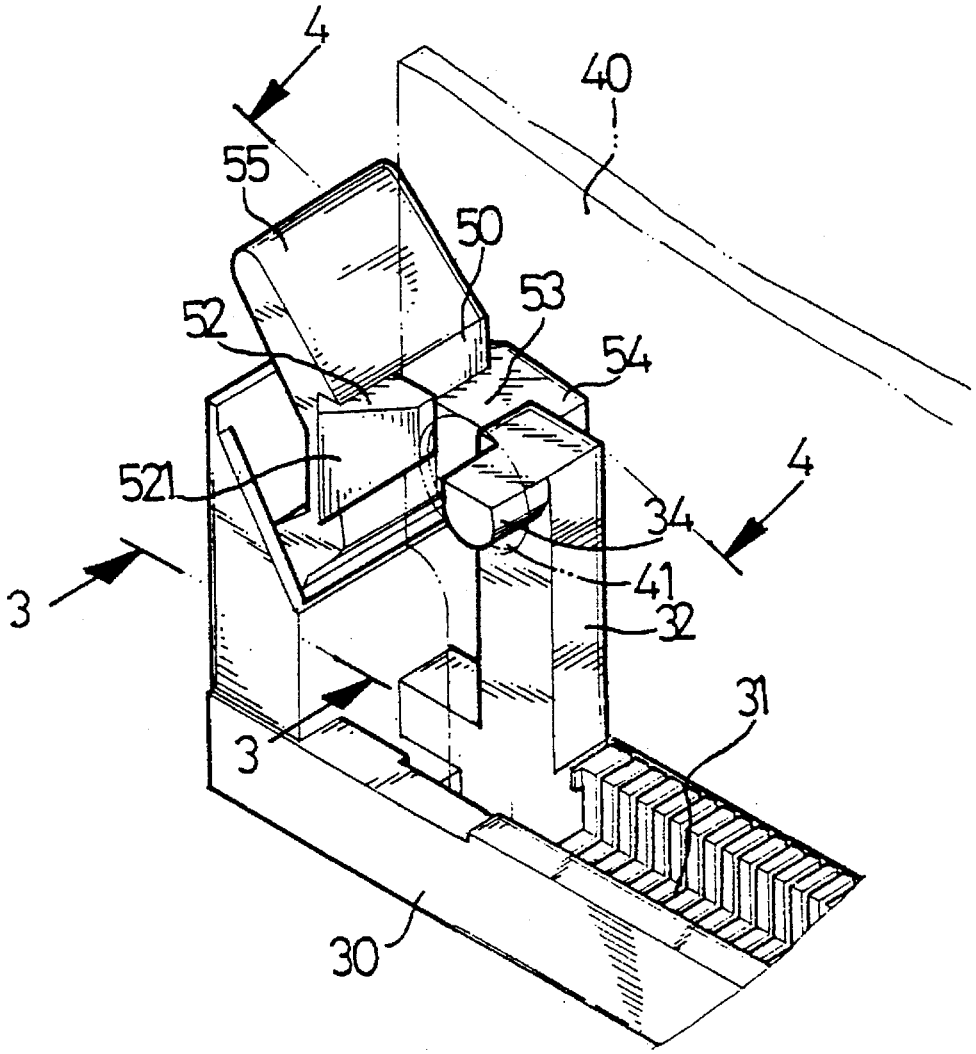
FIG. 1 is a perspective view of a latch mechanism for an electric connector in accordance with the present invention.
Figure 2:
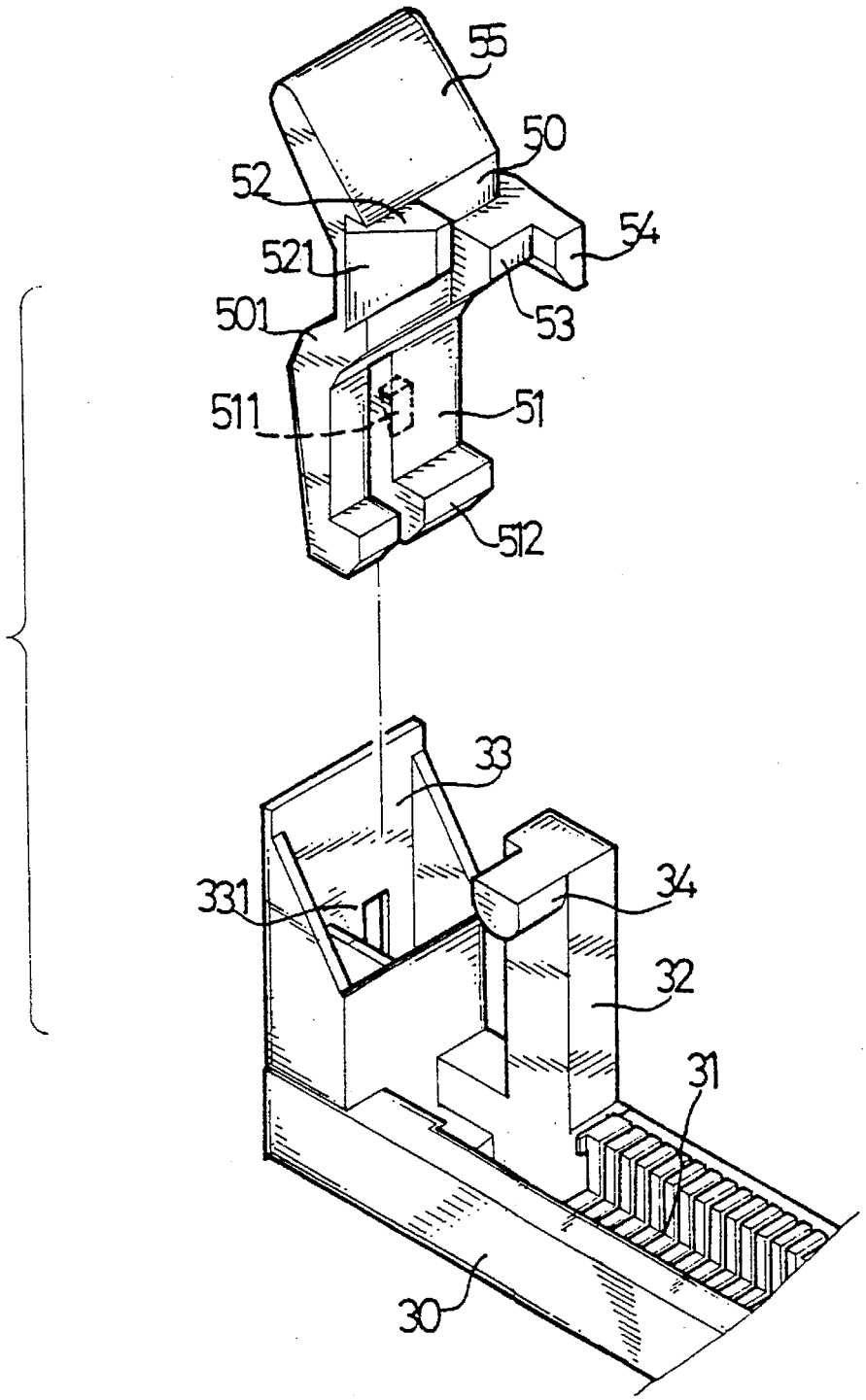
FIG. 2 is an exploded view of the latch mechanism.
Figure 3:
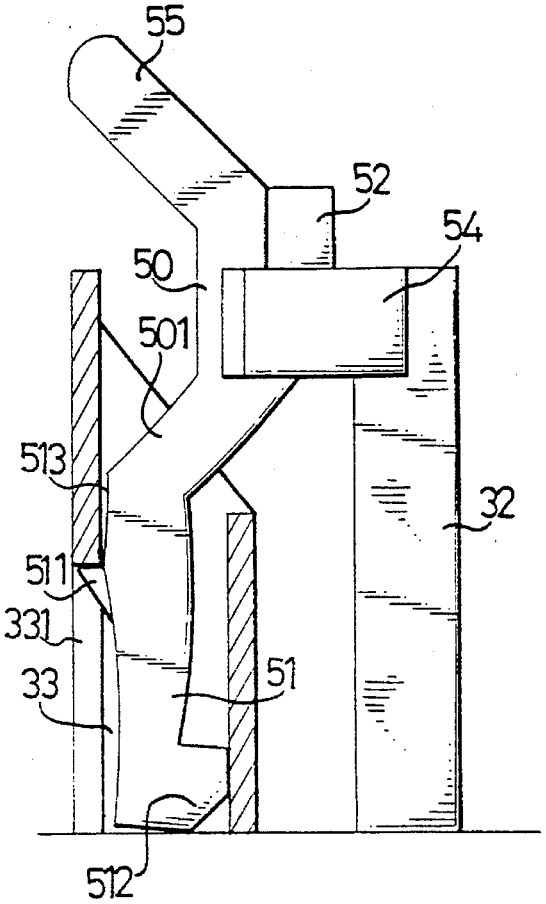
FIGS. 3 and 4 are cross sectional views taken along lines 3—3 and 4—4 of FIG. 1 respectively.

Referring to the drawings, and initially to FIGS. 1 to 4, a latch mechanism for use in an electric connector in accordance with the present invention comprises an elongate housing 30 secured on a mother card (not shown) and including a groove 31 longitudinally formed in the middle portion thereof for receiving and for engaging with a daughter card 40 which is to be secured to the housing 30 and which is to be electrically connected to the mother card. The daughter card 40 includes two orifices 41 formed therein and is rotatable about the bottom thereof which is engaged in the groove 31 of the housing 30. The housing 30 includes two ends each having a casing 33 formed therein and each having a beam 32 extended upward therefrom. The beams 32 each includes an engagement protrusion 34 formed on the upper portion for engaging with the orifices 41 of the daughter card 40, best shown in FIG. 1. The casings 33 each includes a hollow interior and each includes a notch 331 formed therein distal to the beam 32.

Figure 4:
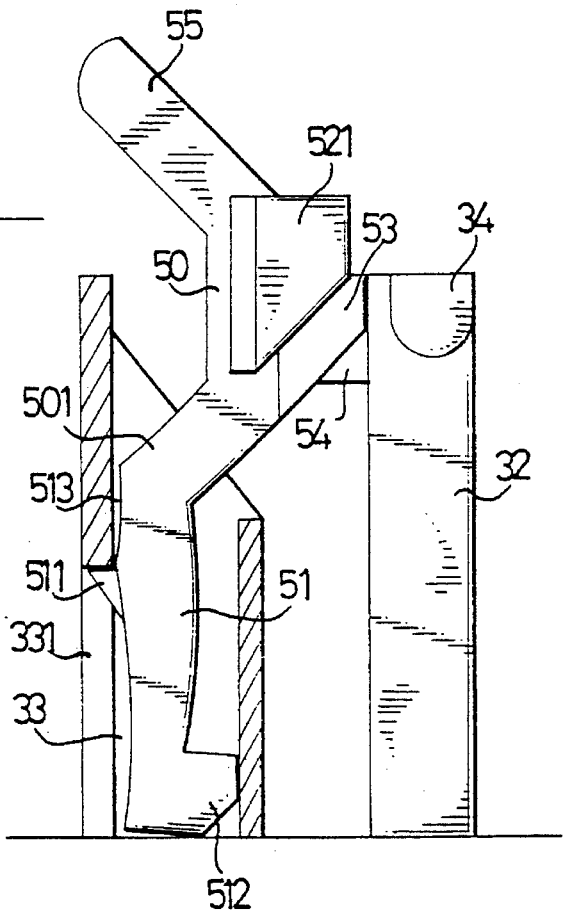
Figure 6:
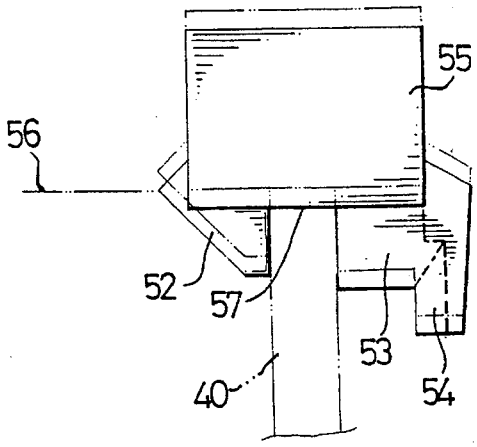
FIG. 6 is a partial top plane view of the latch mechanism.
Figure 5:
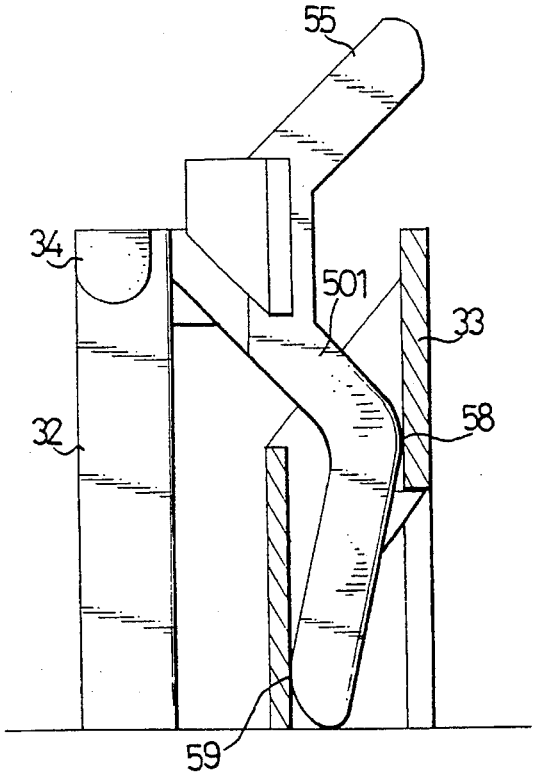
FIG. 5 is a cross sectional view similar to that shown in FIG. 4, illustrating the engagement operation of the latch mechanism.

A pair of latch members 50 each includes a pair of legs 51 provided on the bottom portion for engaging in the hollow interior of the casing 33. It is important that the separated legs 51 may increase the resilience of the latch members 50. If the legs are secured together so as to form a single panel, the resilience of the latch members 50 will be greatly decreased. The legs 51 include a bottom portion having a bulge 512 extended toward the beam 32 for engaging with the casing 33 such that the legs 51 may be force-fitted in the casing 33. The legs 51 include a catch 511 extended opposite to the bulge 512 for engaging with the notch 331 of the casing 33 such that the legs 51 may be stably retained in the casing 33 with a force-fitted engagement. As shown in FIGS. 4 and 5, the legs 51 may be forced into the casing 33 in order to engage the catch 511 with the notch 331 due to the excellent resilience of the legs 51. The legs 51 include an upper portion having an engaging surface 513 for engaging with the casing 33. The latch members 50 each includes a middle portion having a tapered section 501 extended from the upper portion of the legs 51 and extended upward toward the beam 32. A pair of spaced projections 52, 53 are formed on the upper portion of the tapered section 501 and extended toward the beam 32 for engaging with the daughter card 40 therebetween (FIGS. 1 and 6). The projection 53 may engage with the beam 32 (FIG. 3) includes a stop 54 extended therefrom for engaging with the beam 32 so as to stably retain the latch member 50 to the beam 32 and so as to prevent the latch members 50 from being deformed. The projection 52 includes a tapered surface 521 for engaging with the daughter card 40 so as to allow the daughter card 40 to move over the projection 52 and so as to allow the daughter card 40 to be engaged between the projections 52, 53. The latch members 50 each includes a knob 55 provided on top thereof for disengaging the projections 52, 53 from the daughter card 40.

Referring next to FIG. 6, when the daughter card 40 is engaged between the latch members 50, the upper portions of the latch members 50 may be slightly forced outward by the daughter card 40 such that, relatively, the latch members 50 may apply a force against the daughter card 40 so as to resiliently and stably retain the daughter card 40 in place.

Figure 7:
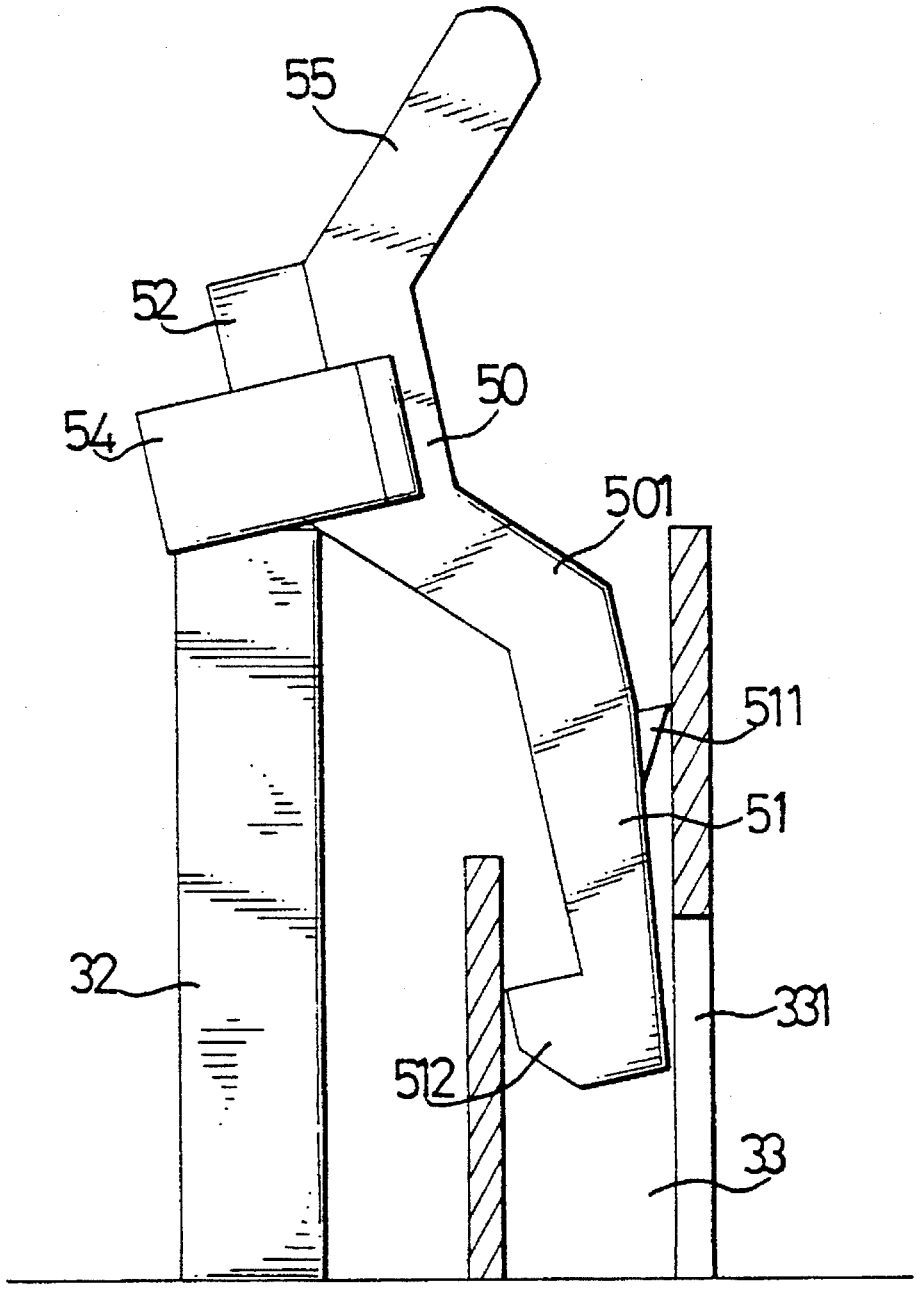
FIG. 7 is a cross sectional view similar to that shown in FIG. 3, illustrating another embodiment of the latch mechanism.

Referring next to FIG. 7, instead of the bulge 512, the latch members 50 may include a tapered leg 59 formed in the bottom portion such that the leg 59 may also be resiliently force-fitted in the casing 33.

Accordingly, the electrical connector in accordance with the present invention includes a pair of latch members each includes a resilient lower portion that may be force-fitted in the casings and that includes an excellent resilience. The latch members further include a stop means for engaging with the beams so as to prevent the latch members from being deformed. In addition, the latch members may apply a force against the daughter card so as to resiliently and stably retain the daughter card therebetween.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric connector for engaging with and for securing a daughter card, the daughter card having two orifices formed therein, said electric connector comprising:

a housing including a middle portion having a groove longitudinally formed therein for engaging with the daughter card and including two ends each having a casing formed thereon and each having a beam extended upward therefrom, said beams each including an engaging protrusion means extended therefrom for engaging with the orifices of the daughter card, said casings each including a hollow interior and each including a notch formed therein distal to said beam, a pair of latch members each including a lower portion having a pair of spaced legs formed therein for engaging with said casings and for being force-fitted in said casings, said legs including a catch means extended therefrom for engaging with said notch so as to secure said latch members to said casing, said latch members each including a tapered middle portion for increasing a resilience of said latch members, said tapered middle portion of said latch members each including an upper portion having a pair of projections extended therefrom for engaging with the daughter card therebetween, a first of said projections including a tapered surface formed therein for engaging with the daughter card and for allowing the daughter card to be moved over said first projection and to be engaged between said projections, said latch members each including a knob provided on top thereof for operating said latch members and for disengaging said engaging protrusion means from the orifices of the daughter card, said latch members being arranged for applying a force against the daughter card so as to resiliently and stably retain the daughter card in place, and said projections include a second projection having a stop extended therefrom for engaging with said beam so as to stably retain said latch members to said beams and so as to prevent said latch members from being deformed.

2. An electric connector according to claim 1 wherein said legs include a tapered configuration for engaging with said casing so as to be force-fitted in said casing.

* * * * *